United States Patent [19]

Kondo et al.

[11] 4,321,903

[45] Mar. 30, 1982

[54] METHOD OF FEEDBACK CONTROLLING AIR-FUEL RATIO

[75] Inventors: Toshio Kondo, Anjo; Akio Kobayashi; Tomomi Eino, both of Kariya; Naofumi Fukue, Chiryu, all of Japan

[73] Assignee: Nippondenso Co., Ltd., Kariya, Japan

[21] Appl. No.: 127,545

[22] Filed: Mar. 6, 1980

[30] Foreign Application Priority Data

Apr. 26, 1979 [JP] Japan ..... 54/51682

[51] Int. Cl.[3] ..... F02B 3/00

[52] U.S. Cl. ..... 123/440; 123/489

[58] Field of Search ..... 123/440, 489; 60/276, 60/285

[56] References Cited

U.S. PATENT DOCUMENTS 4,187,812 2/1980 Hosaka ..... 123/440

4,235,204 11/1980 Rice ..... 123/440

*Primary Examiner*—Ronald B. Cox

*Attorney, Agent, or Firm*—Cushman, Darby & Cushman

[57] ABSTRACT

In the method of feedback controlling the air-fuel ratio of an internal combustion engine, the feedback control is stopped for a predetermined period of time at a specified time or condition of the engine, and the air-fuel ratio is controlled in accordance with a control signal having a value corresponding to the average value of the integrated compensation signals. In addition, a factor affecting the center value of the controlled air-fuel ratio is adjusted in accordance with the output signal of a comparator circuit generated during the time that the feedback control is being stopped.

4 Claims, 6 Drawing Figures

METHOD OF FEEDBACK CONTROLLING AIR-FUEL RATIO

BACKGROUND OF THE INVENTION

The invention relates to a method of feedback controlling the air-fuel ratio of mixture by means of an air-fuel ratio sensor positioned in the exhaust gases from an engine for automobiles or the like.

In a known type of feedback air-fuel ratio control method employing reducing and oxidizing catalysts, it is necessary to control the air-fuel ratio of mixture in such a manner that the center value of the controlled air-fuel ratio or the controlled center air-fuel ratio comes into a very narrow range of air-fuel ratios around the stoichiometric ratio required by the reducing and oxidizing catalysts as shown in FIG. 1.

However, the controlled center air-fuel ratio will be affected by the characteristics of an air-fuel ratio sensor and the exhaust gas composition characteristic is dependent to a considerable extent on the variations in characteristics caused by different air-fuel ratio sensors.

The air-fuel ratio sensor characteristics which affect the controlled center air-fuel ratio include the output characteristic (hereinafter referred to as a static characteristic) which is a stepwise relation between the sensor output and the air-fuel ratio as shown in FIG. 2 and another characteristic (hereinafter referred to as a dynamic characteristic) involving differences in response delay between the sensor output when the air-fuel ratio is changing from the rich side (no oxygen is present in the exhaust gases) of a desired (stoichiometric) air-fuel ratio to the lean side (oxygen is present in the exhaust gases) and the sensor output when the air-fuel ratio is changing in the reverse direction. These characteristics differ with different sensors or different use conditions and the resulting controlled center air-fuel ratio also differs similarly. As a result, the exhaust gas composition characteristic also differs with different sensors or different use conditions.

In accordance with the present invention, it has been found that the output of the air-fuel ratio sensor changes abruptly in response to a threshold or a comparison voltage (corresponding to a predetermined air-fuel ratio) of a comparator circuit for determining whether the air-fuel ratio is great (lean) or small (rich) as compared with the predetermined air-fuel ratio, that if the air-fuel ratio sensor is warmed sufficiently, the sensor output characteristic (static characteristic) will not vary greatly with different sensors or different use conditions and that the previously mentioned dynamic characteristic is a major cause of variations in the controlled center air-fuel ratio.

SUMMARY OF THE INVENTION

With a view to overcoming the foregoing deficiencies, it is the object of the present invention to provide a feedback type air-fuel ratio control method employing an air-fuel ratio sensor for sensing the air-fuel ratio of the mixture from the composition of the exhaust gases from an engine, and a comparator circuit for comparing the output voltage of the air-fuel ratio sensor with a comparison voltage corresponding to a predetermined air-fuel ratio so as to determine whether the air-fuel ratio is greater than the predetermined ratio, whereby the output signal of the comparator circuit is integrated and the air-fuel ratio is feedback controlled in accordance with at least the resulting integrated compensation signal. The method is characterized in that the feedback control is stopped for a predetermined period of time at a specified time or condition of an engine and the air-fuel ratio is controlled by a control signal having a value corresponding to the average value of the integrated compensation amount and that a factor tending to affect the center value of the controlled air-fuel ratio is corrected in accordance with the output signal of the comparator circuit during the time that the feedback control is being stopped, thus providing compensation for the variations in detection response delay caused by different air-fuel ratio sensors and thereby highly accurately controlling the center value of the controlled air-fuel ratio to approach a desired air-fuel ratio.

In accordance with this invention, the factors which cause variations in the center value of the controlled air-fuel ratio include a delay time by which is retarded the time to change the output signal of the comparator circuit and other factors such as an integration time constant for the integration operation and a so-called skip amount to be added to or subtracted from the compensation signal derived by the integration operation.

DESCRIPTION OF THE PREFERRED EMBODIMENT

The invention will now be described in greater detail with reference to the illustrated embodiment.

Figure 1:
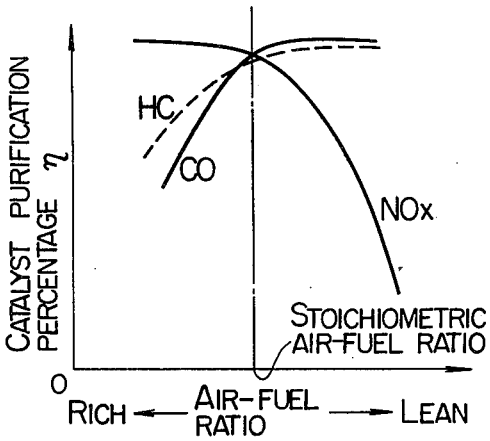
FIG. 1 is a purification percentage characteristic diagram for a three-way catalytic converter.
Figure 2:
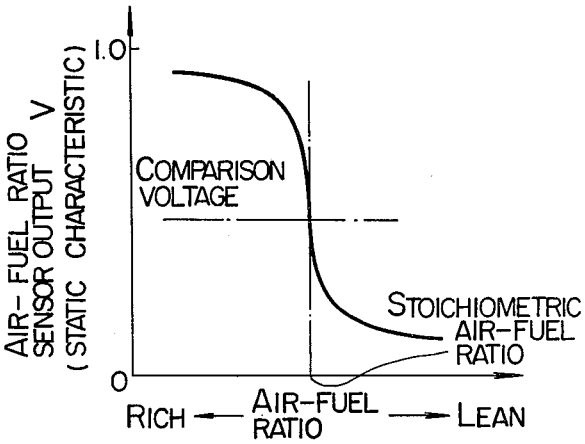
FIG. 2 is an output characteristic (static characteristic) diagram for an air-fuel ratio sensor.
Figure 3:
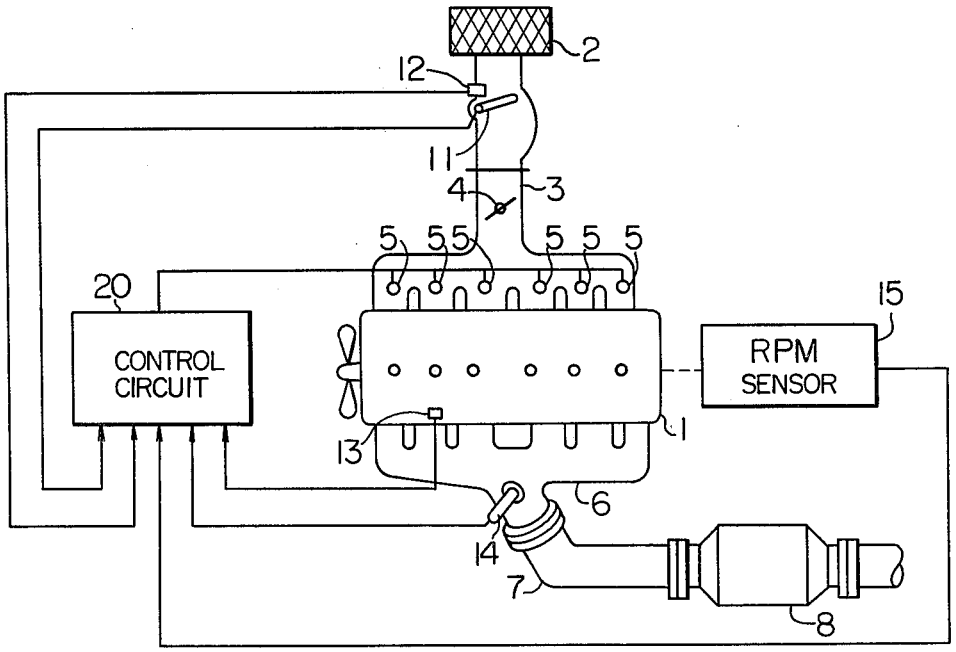
FIG. 3 is a schematic diagram showing the construction of an apparatus for performing the method of this invention.

Referring to FIG. 3 showing an embodiment of an apparatus for performing the method of the invention, an engine 1 is a known type of four-cycle spark ignition engine adapted for installation in automotive vehicles and the combustion air is sucked into the engine 1 by way of an air cleaner 2, an intake pipe 3 and a throttle valve 4. The fuel is supplied to the engine 1 from the fuel system (not shown) through electromagnetic fuel injection valves 5 mounted in the respective cylinders. The exhaust gases produced by the combustion are discharged to the atmosphere through an exhaust manifold 6, an exhaust pipe 7, a three-way catalytic converter 8 incorporating reducing and oxidizing catalysts, and so on. Disposed in the intake pipe 3 are a potentiometer type air flow sensor 11 for detecting the amount of air sucked into the engine 1 and generating an analog voltage corresponding to the amount of air flow and a thermistor type intake air temperature sensor 12 for detecting the temperature of the air drawn into the engine 1 and generating an analog voltage (analog detection signal) corresponding to the intake air temperature. Also mounted in the engine 1 is a thermistor type water temperature sensor 13 for detecting the engine cooling water temperature and generating an analog voltage (analog detection voltage) corresponding to the cooling water temperature, and mounted in the exhaust manifold 6 is an air-fuel ratio sensor 14 for detecting the air-fuel ratio of the mixture from the concentration of oxygen in the exhaust gases. An engine speed (rpm) sensor 15 detects the rotational speed of the crankshaft of the engine 1 and generates a pulse signal having a frequency corresponding to the rotational speed. The engine speed (rpm) sensor 15 may be comprised, for example, of the ignition coil of the ignition system so as to use the ignition pulse signal from the primary winding of the ignition coil as an engine speed signal. A control circuit 20 is responsive to the detection signals from the sensors 11 to 15 so as to compute the amount of fuel to be injected, and the fuel injection quantity is adjusted by controlling the duration of opening of the electromagnetic fuel injection valves 5.

Figure 4:
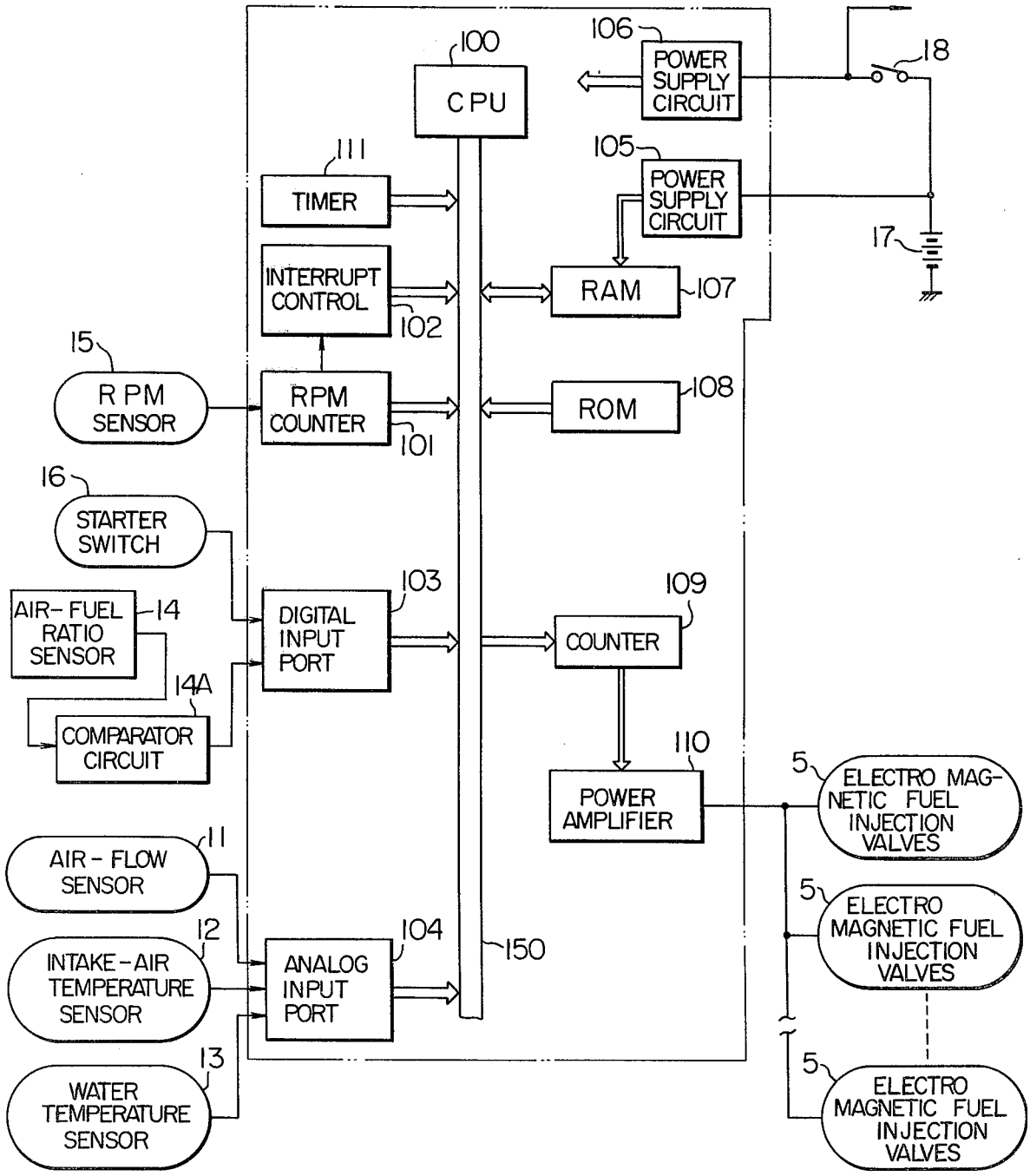
FIG. 4 is a block diagram for the control circuit shown in FIG. 3.

The control circuit 20 will now be described in greater detail with reference to FIG. 4. In the Figure, numeral 100 designates a microprocessor (CPU) for computing the amount of fuel injection. Numeral 101 designates an RPM counter for detecting the engine speed by counting the signals from the RPM sensor 15. The RPM counter 101 supplies an interrupt command signal to an interrupt control 102 in synchronism with the engine rotation. The interrupt control 102 is responsive to the applied interrupt command signal to generate and apply an interrupt signal to the microprocessor 100 through a common bus 150. Numeral 103 designates a digital input port for transmitting to the microprocessor 100 digital signals including the output signal of a known type of comparator circuit 14A for comparing the terminal output of the air-fuel ratio sensor 14 with a comparison voltage corresponding to a desired (stoichiometric) air-fuel ratio to determine whether the air-fuel ratio is great (lean) or small (rich) compared with the desired air-fuel ratio and the starter signal from a starter switch 16 for turning on and off the starter which is not shown. Numeral 104 designates an analog input port comprising an analog multiplexer and an A-D converter to serve the function of subjecting the signals from the air-flow sensor 11, the intake air temperature sensor 12 and the cooling water temperature sensor 13 to A-D conversion and successively writing the signals into the microprocessor 100. The output information from these units 101, 102, 103 and 104 are transmitted to the microprocessor 100 by way of the common bus 150. Numeral 105 designates a power supply circuit for supplying power to a RAM 107 which will be described later. Numeral 17 designates a battery, and 18 a key switch. The power supply circuit 105 is connected to the battery 17 directly and not through the key switch 18. Thus the power is always applied to the RAM 107 irrespective of the condition of the key switch 18. Numeral 106 designates another power supply circuit connected to the battery 17 through the key switch 18. The power supply circuit 106 supplies the power to all the component parts of the circuit excepting the RAM 107 which will now be described. The RAM 107 is a temporary memory unit which is used temporarily when a program is being run and it forms a nonvolatile memory so that the power is always supplied irrespective of the condition of the key switch 18 as mentioned previously and the stored contents are not erased even if the key switch 18 is turned off and the engine operation is stopped. Numeral 108 designates a read-only memory (ROM) for storing the program and various kinds of constants and the like. Numeral 109 designates a fuel injection time controlling counter including a register and it comprises a down counter whereby a digital signal indicative of the duration of opening of the electromagnetic fuel injection valves 5 or the amount of fuel injection computed by the microprocessor (CPU) 100, is converted to a pulse signal having a time width which determines the actual duration of opening of the electromagnetic fuel injection valves 5. Numeral 110 designates a power amplifier for actuating the electromagnetic fuel injection valves 5, and 111 a timer for measuring and supplying the time elapsed to the CPU 100.

The RPM counter 101 is responsive to the output of the RPM sensor 15 so that the engine rpm is measured once for every revolution of the engine and an interrupt command signal is applied to the interrupt control 102 at the end of each measurement. In response to the interrupt command signal, the interrupt control 102 generates an interrupt signal and causes the microprocessor 100 to perform an interruption handling routine for computing the amount of fuel injection.

Figure 5:
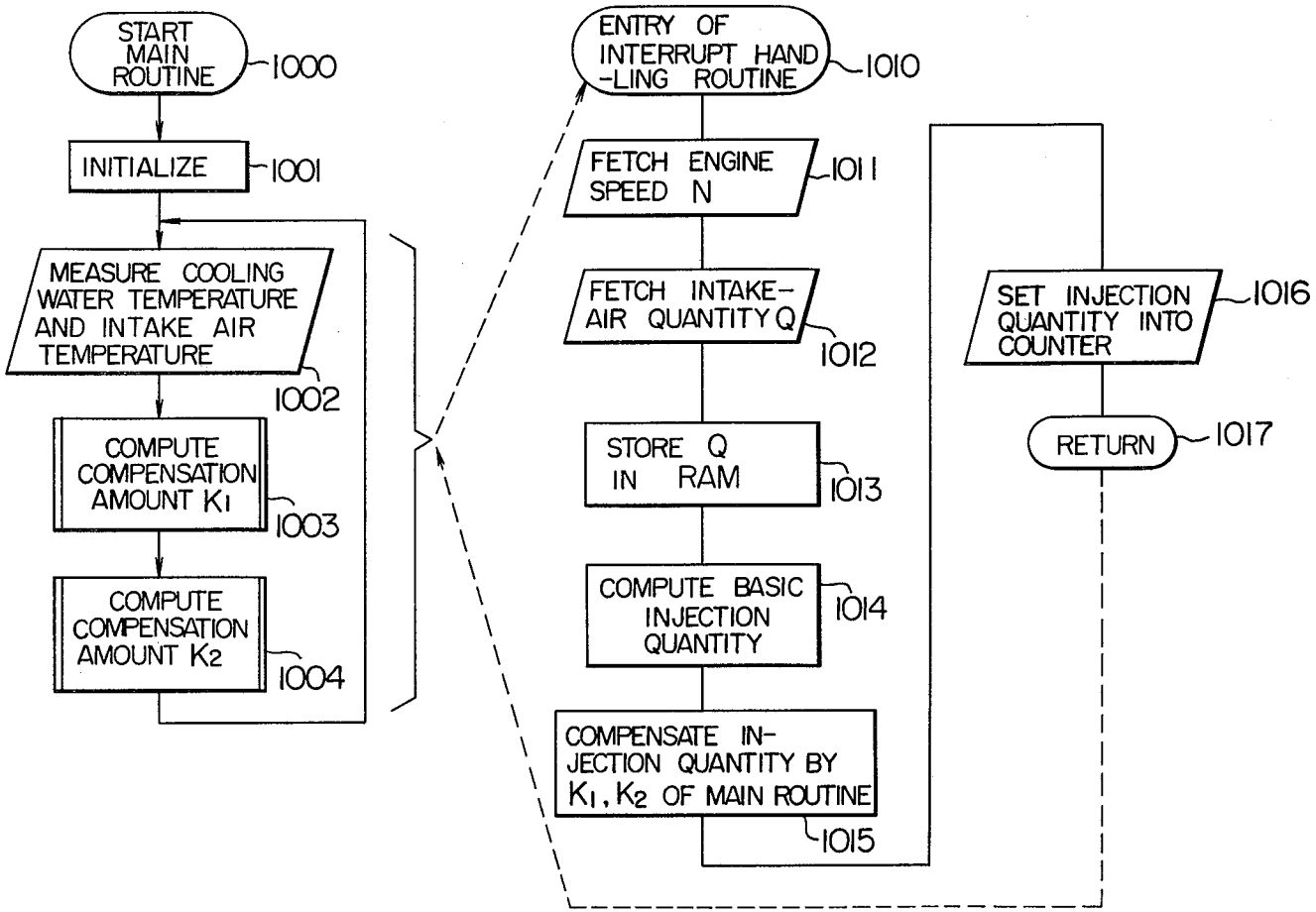
FIG. 5 is a simplified flow chart for the microprocessor shown in FIG. 4.
Figure 6:
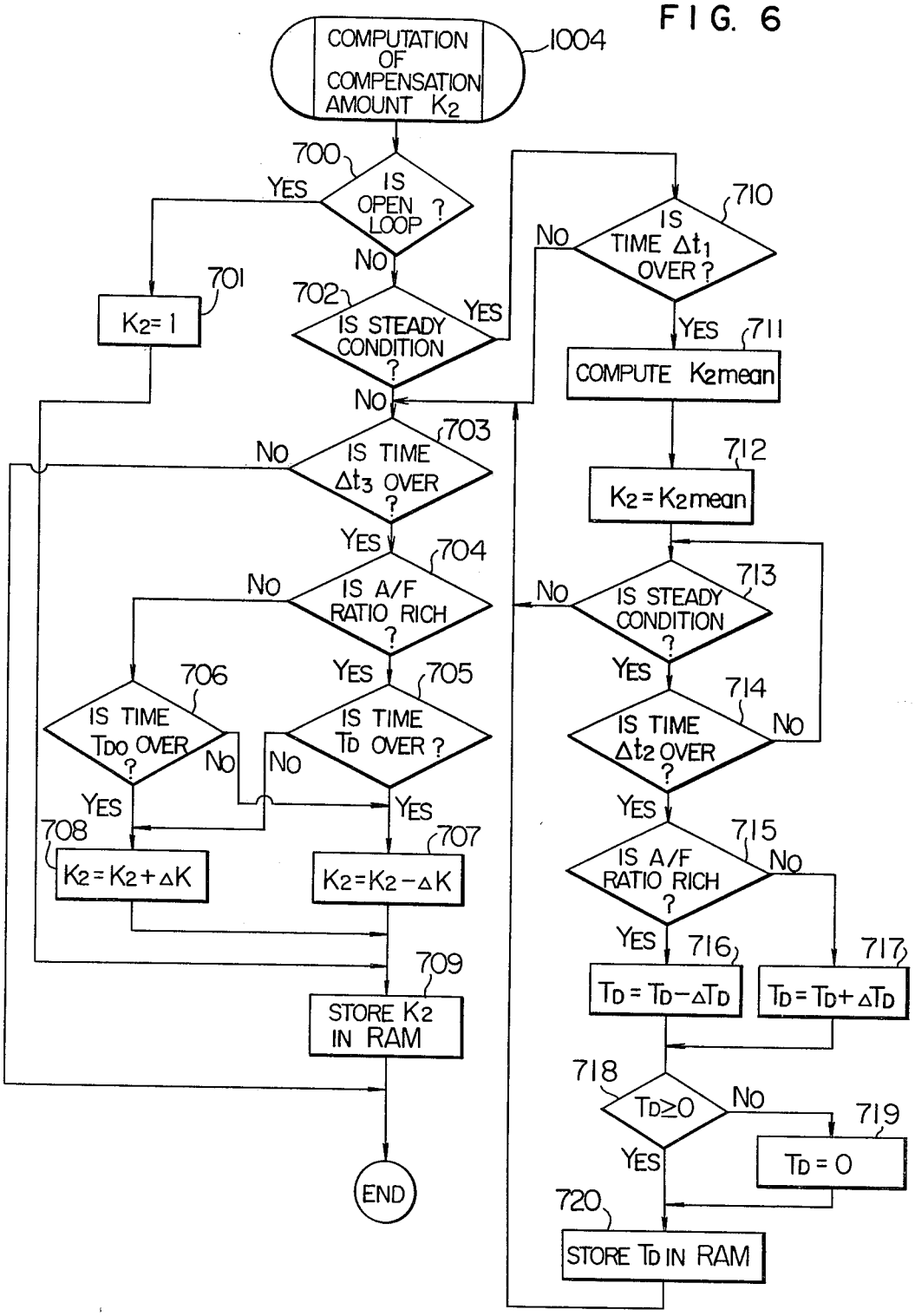
FIG. 6 is a detailed flow chart for the step 1004 shown in FIG. 5.

FIG. 5 shows a simplified flow chart for the microprocessor 100 and the function of the microprocessor 100 as well as its overall operation will now be described with reference to the flow chart. When the key switch 18 and the starter switch 16 are turned on so that the engine is started, the computational operation of the main routine is started by a first step 1000 and the required initialization is performed by a step 1001. By the next step 1002, the digital values indicative of the cooling water temperature and the intake air temperature are read in from the analog input port 104. A step 1003 computes a compensation amount $K_1$ from the result of the step 1002 and the computed amount is stored in the RAM 107. A step 1004 reads in through the digital input port 1003 the output signal of the comparator circuit 14A adapted to operate on the signal from the air-fuel ratio sensor 14, so that as a function of the elapsed time measured by the timer 111, a compensation amount $K_2$ which will be described later is increased or decreased and the compensation amount $K_2$ or the integrated information is stored in the RAM 107. FIG. 6 is a detailed flow chart of the processing step 1004 which varies or integrates the compensation amount $K_2$ as the integrated information. Initially, a step 700 determines whether the air-fuel ratio sensor is in an activated state or whether the air-fuel ratio can be feedback controlled according to the cooling water temperature, etc., so that if the feedback control is not possible or in the open loop condition, the control is transferred to a step 701 which in turn corrects the compensation amount $K_2$ to $K_2=1$ and transfers the control to a step 709. When the feedback control is possible, the control is transferred to a step 702. The step 702 determines whether an operating condition of the engine is steady or is maintained constant. While it is possible to establish any of various operating conditions which may be considered as representative of the steady operating condition, the engine is considered to be in the steady condition when the rate of change with time of the air flow to the engine is small. More specifically, the engine is considered in the steady operating condition when there is the following relation $$Q(t)-Q(t-\Delta t)\leqq\Delta Q_0$$

where Q is the amount of air sucked and $\Delta Q_0$ is a preset value. When the engine condition is not steady, the control is transferred to a step 703 which determines whether a predetermined time $\Delta t_3$ has elapsed since the preceding computing cycle. When it is not the case, the processing step 1004 is completed. When the time $\Delta t_3$ is already over, a step 704 determines from the discrimination output of the comparator circuit 14A whether the air-fuel ratio is small (rich) or great (lean) compared with the predetermined ratio. If the air-fuel ratio is rich, the control is transferred to a step 705 which determines whether a delay time $T_D$ which will be described later in detail has elapsed since the air-fuel ratio becomes rich. If the time $T_D$ is already over, the control is transferred to a step 707 so that a predetermined value $\Delta K$ is subtracted from the compensation amount $K_2$ obtained by the preceding computation and stored in the RAM 107, that is, the compensation amount $K_2$ is computed in such a manner that the air-fuel ratio is made lean compared with the predetermined ratio. If the time $T_D$ is not over, the control is transferred to a step 708 which adds the value $\Delta K$ to the previous compensation amount $K_2$. Since the compensation amount $K_2$ is computed so as to make the air-fuel ratio rich when the time $T_D$ is not over, if the delay time $T_D$ is large, the center value of the controlled air-fuel ratio or the controlled center air-fuel ratio is adjusted to become rich, whereas if the delay time $T_D$ is small, the controlled center air-fuel ratio is adjusted to become lean. If the step 704 determines that the air-fuel ratio is lean, the control is transferred to a step 706 which determines whether a predetermined delay time $T_{DO}$ has elapsed since the air-fuel ratio becomes lean. If the predetermined time $T_{DO}$ is already over, the control is transferred to a step 708 so that the value $\Delta K$ is added to the previous compensation amount $K_2$ and the compensation amount $K_2$ is computed so as to make the air-fuel ratio rich. If the predetermined time $T_{DO}$ is not over, the control is transferred to a step 707 which subtracts the value $\Delta K$ from the previous compensation amount $K_2$. After the computation by integration of the latest compensation amount $K_2$ by the step 707 or 708, the control is transferred to a step 709 so that the computed amount $K_2$ is stored in the RAM 107 for use in the next computing cycle and the processing step 1004 is completed. If the previous step 702 determined by the engine condition is steady, that is, if the rate of change of the air flow is small, the control is transferred to a step 710 which determines whether a predetermined time $\Delta t_1(\Delta t_1 > \Delta t_3)$ has elapsed since the engine condition was determined steady. If the time $\Delta t_1$ is not over, the control is transferred to the step 703 so that the compensation amount $K_2$ is decreased or increased by the step 707 or 708. If the time $\Delta t_1$ is over, the control is transferred to a step 711. The step 711 computes an average value $K_{2mean}$ of as many compensation quantities $K_2$ as obtained and stored in the RAM 107 during the time $\Delta t_1$. The average value $K_{2mean}$ may be replaced with a value intermediate between the maximum and minimum values of $K_2$ during the time $\Delta t_1$, for example. The next step 712 substitutes the average value $K_{2mean}$ for $K_2$ in the corresponding location of the RAM 107 in which $K_2$ is to be stored by the step 709. The next step 713 determines whether the engine condition is steady as in the case of the step 702. If the engine condition is steady, the control is transferred to a step 714 which determines whether a predetermined time $\Delta t_2$ has elapsed since the engine condition was determined steady. If it is not, the control is returned to the step 713 and the processes of the steps 713 and 714 are repeated. If the time $\Delta t_2$ is over, the control is transferred to the next step 715. If the step 713 determined by the engine condition is not steady, the control is transferred to the step 703. In other words, the steps 713 and 714 are such that if the engine condition remains steady over the time $\Delta t_2$, in the compensating computation of the injection quantity by a step 1015 of an interrupt handling routine 1010 which will be described later, only during the time $\Delta t_2$ the computation is effected by using the average value $K_{2mean}$ as the compensation amount $K_2$ and consequently the air-fuel ratio is maintained at a fixed value corresponding to the value $K_{2mean}$ during the time $\Delta t_2$. If the engine is not maintained in the steady condition over the time $\Delta t_2$, by the processes of the steps 703 et seq. the integration operation of the compensation amount $K_2$ is performed and the compensating computation of the injection quantity with the compensation amount $K_2$ or the feedback control of the air-fuel ratio is restarted. If the step 714 determines that the time $\Delta t_2$ is over (or when the air-fuel ratio is maintained at the fixed value corresponding to the average value $K_{2mean}$ during the time $\Delta t_2$), the control is transferred to the step 715 which determines whether the air-fuel ratio is rich or lean. If the air-fuel ratio is rich, the control is transferred to a step 716 which subtracts a predetermined value $\Delta T_D$ from the delay time $T_D$ for delaying the time at which the signal from the comparator circuit 14A (or the air-fuel ratio) is changed from the rich to the lean side. In other words, in the steady condition of the engine the air-fuel ratio is compensated by the average value $K_{2mean}$ of the compensation amounts $K_2$ for the duration of the time $\Delta t_2$ and the output of the air-fuel ratio sensor after the time $\Delta t_2$ or the controlled air-fuel ratio is measured to see if it is rich or lean as compared with the desired air-fuel ratio. If the air-fuel ratio is rich, the delay time $T_D$ is decreased gradually so that the controlled center air-fuel ratio is compensated gradually to become leaner and it is thus adjusted to approach the desired air-fuel ratio. In this way, compensation is provided for the variations in controlled center air-fuel ratio due to the variations in detection response delay (or dynamic characteristic) caused by different air-fuel ratio sensors. If the step 715 determines that the controlled air-fuel ratio is lean, the control is transferred to a step 717 so that the delay time $T_D$ is increased by the value $\Delta T_D$ and the controlled center air-fuel ratio is compensated to become rich. After the process of the step 716 or 717 has been completed, the control is transferred to a step 718 which determined whether the delay time $T_D$ computed by the step 716 or 717 is greater than zero. If it is not, the control is transferred to a step 719 which reduces the delay time $T_D$ to zero. If the step 718 determines that the delay time $T_D$ is greater than zero or when the process of the step 719 is completed, the control is transferred to a step 720 so that the delay time $T_D$ is stored in the RAM 107 and then the control is transferred to the step 703, thus performing the previously mentioned processes. The delay time $T_D$ stored in the RAM 107 is read out and used in the subsequent operation of the step 705.

The initialization process by the step 1001 can also perform the following process. More specifically, the battery may occasionally be removed when a vehicle undergoes an inspection or repair. In such a case, there is the danger of the delay time $T_D$ stored in the RAM 107 being destroyed and converted to an insignificant value. Thus, a constant having a predetermined pattern is usually stored in a specified location of the RAM 107 so as to check whether the battery has been removed.

When the program is started, whether the value of the constant has been destroyed or converted to an erroneous value is determined so that if the value is wrong, it is considered that the battery has been removed and the value of the delay time $T_D$ is initialized to its predetermined value, thus resetting the constant of the predetermined pattern. When the program is restarted, if the pattern constant has not been destroyed, the delay time $T_D$ will not be initialized.

Normally, the processes of the steps 1002 to 1004 in the main routine are repeatedly performed in accordance with the control program. When an interrupt signal for fuel injection quantity computation is applied from the interrupt control 102, even if the main routine is being executed, the microprocessor 100 immediately interrupts the operation of the main routine and proceeds to the interrupt handling routine of a step 1010. The step 1010 takes in the output signal of the RPM counter 101 indicative of the engine speed N and the next step 1012 takes in from the analog input port 104 the signal indicative of the amount of air flow or the intake-air quantity Q. The next step 1013 stores the intake-air quantity Q in the RAM 107 so that it may be used as a parameter for the detection of normal condition in the computation of compensation amount $K_2$ by the step 1002 of the main routine. The next step 1014 computes a basic fuel injection quantity (or the injection time duration $\tau$ of the electromagnetic fuel injection valves 5) which is determined by the engine speed N and the intake-air quantity Q. The calculating formula is $\tau = F \times Q/N$, where F is a constant. The next step 1015 reads out from the RAM 107 the fuel injection quantity compensation amounts $K_1$ and $K_2$ computed by the main routine and then compensates the injection quantity (injection time duration) which determines the air-fuel ratio. The calculating formula for this injection time duration T is $T = \tau \times K_1 \times K_2$. The next step 1016 introduces the thusly compensated fuel injection quantity data into the counter 109. Then, the microprocessor procedes to the next step 1017 which returns the control to the main routine. In this case, the control is returned to the processing step which was interrupted by the interruption processing.

The function of the microprocessor 100 has been described so far briefly.

While, in the embodiment described above, the processes of the steps 710, 714 and 703 respectively determine whether the predetermined times $\Delta t_1$, $\Delta t_2$ and $\Delta t_3$ have elapsed in the computation of the integrated compensation amount $K_2$ shown in FIG. 6, whether the engine has rotated predetermined numbers of revolutions $\Delta N_1$, $\Delta N_2$ and $\Delta N_3$ (or whether the times corresponding to $\Delta N_1$, $\Delta N_2$ and $\Delta N_3$ have elapsed) may be determined instead.

Further, while, in the above-described embodiment, the delay time $T_D$ or the factor causing variations in the center value of controlled air-fuel ratio is computed irrespective of the engine conditions, it is possible to provide a delay time $T_D$ for each of engine operating conditions which may for example be classified according to the values of the intake-air quantity Q and the engine speed N to form a known type of map so as to compute the corresponding delay time $T_D$ for each engine condition and update the stored value.

Still further, while, in the above embodiment, the factor for causing variations in the center value of controlled air-fuel ratio or the delay time $T_D$ for delaying the time to change the output signal of the comparator circuit 14A is computed and adjusted, it is possible, for example, to adjust the time constant or the correction value $\Delta K$ for the compensation amount $K_2$ or the time $\Delta t_3$ in the integration operation, and alternatively another compensation amount $K_3$ may be added to or subtracted from the integrated compensation amount $K_2$ so as to adjust the compensation amount $K_3$.

Still further, while, in the embodiment, the feedback control is stopped so that the air-fuel ratio is controlled by the average value $K_{2mean}$ of the compensation amounts $K_2$ and whether the then current air-fuel ratio is rich or lean is determined so as to adjust the delay time $T_D$, it is possible to add or subtract a predetermined value $\Delta K_{2mean}$ from the average value $K_{2mean}$ of the compensation amounts $K_2$ so that the air-fuel ratio is controlled to the value of $K_{2mean} + (\pm \Delta K_{2mean})$ so as to adjust the delay time $T_D$. In this case, the center value of the controlled air-fuel ratio can be controlled to a value which deviates from the desired (stoichiometric) air-fuel ratio by an amount corresponding to $\Delta K_{2mean}$.

Still further, while, in the above embodiment, the air-fuel ratio is controlled by adjusting the compensation amount for the injection quantity in electronically controlled fuel injection, it is of course possible to apply the invention to an arrangement in which the air-fuel ratio (the oxygen content of the exhaust gases) is controlled by adjusting the compensation amount for the amount of fuel to be supplied to the carburetor or the amount of air bypassing the carburetor or alternatively by adjusting compensation amount for the amount of secondary air supplied to the engine exhaust system.

We claim:

1. A method of controlling the air-fuel ratio of an internal combustion engine having a member affecting the air-fuel ratio comprising the steps of:

(a) sensing the oxygen concentration in the exhaust gases of said internal combustion engine;

(b) sensing an operating condition of said internal combustion engine;

(c) when said sensed operating condition is changing, (c1) incrementally changing a correction value in a direction the same as the previous incrementally changing step except for the first incrementally changing step following a delay interval from a passing of said sensed oxygen concentration through a predetermined value, said correction value being incrementally changed in a direction opposite the previous incrementally changing step during said first incrementally changing step, and (c2) controlling said member using said calculated correction value;

(d) when said sensed operating condition is not changing, (d1) averaging said correction value used to control said member in said controlling step (c2), (d2) controlling said member using said averaged correction value during a predetermined interval, and (d3) varying said delay interval in response to said oxygen concentration sensed after said predetermined interval by said sensing step (a); and (e) repeating the above sequence of steps (a) to (d) using said varied delay interval in said calculating step (c1).

2. An apparatus for controlling the air-fuel ratio of mixture to be supplied to an internal combustion engine comprising:

means for sensing the air-fuel ratio of mixture supplied to said internal combustion engine;

means for comparing said sensed air-fuel ratio with a predetermined value;

means for sensing changes in the amount of air sucked into said internal combustion engine;

means for integrating, when the output of said changes sensing means is indicative of the presence of change, the output of said comparing means, the integrating direction being reversed following a delay interval after said comparing means has determined said sensed air-fuel ratio has crossed said predetermined value;

means for averaging, when the output of said changes sensing means is indicative of the absence of changes, the output of said integrating means used over a predetermined interval by said controlling means;

means for controlling the air-fuel ratio of a mixture to be supplied to said internal combustion engine using the output of said integrating means when the output of said changes sensing means is indicative of the presence of change and using the output of said averaging means for a predetermined interval when the output of said changes sensing means is indicative of the absence of change; and means for varying said delay interval in accordance with the output of said ratio sensing means after said predetermined interval.

3. In a method of feedback controlling the air-fuel ratio of an internal combustion engine including the steps of monitoring an air-fuel ratio from the composition of the exhaust gases from the engine with an air-fuel ratio sensor, comparing an output voltage of the air-fuel ratio sensor with a comparison voltage indicative of a predetermined air-fuel ratio with a comparison circuit so as to determine whether the air-fuel ratio is greater than the predetermined air-fuel ratio, integrating an output signal of the comparison circuit, and feedback controlling the air-fuel ratio in accordance with at least said integrated output signal, the improvement further comprising the steps of:

stopping said feedback controlling step for a predetermined period of time and controlling said air-fuel ratio in accordance with a control signal having a value corresponding to an average value of a plurality of said integrated output signal; and adjusting a factor affecting the center value of said controlled air-fuel ratio in accordance with an output signal of said comparison circuit generated during said feedback control stopping interval.

4. A method according to claim 3, wherein said adjusting step further includes the step of adjusting a delay interval after which the direction of integration in said integrating step is changed after each change in said output signal.

* * * * *